US005164630A

United States Patent [19]

Greiler et al.

[11] Patent Number: 5,164,630

[45] Date of Patent: Nov. 17, 1992

[54] SINGLE-BASED HIGH-PRESSURE DISCHARGE LAMP

[75] Inventors: Wolfgang Greiler, Unterhaching; Andreas Genz, Berlin; Bernd Lewandowski, Feldafing, all of Fed. Rep. of Germany

[73] Assignee: Patent Treuhand Gesellschaft Fur Elektrische Gluhlampen mbH, Munich, Fed. Rep. of Germany

[21] Appl. No.: 732,063

[22] Filed: Jul. 18, 1991

[30] Foreign Application Priority Data

Sep. 19, 1990 [DE] Fed. Rep. of Germany ..... 9013279

[51] Int. Cl.[5] ..... H01J 61/30; H01J 61/36

[52] U.S. Cl. ..... 313/25; 313/253; 313/269; 313/634

[58] Field of Search ..... 313/25, 566, 269, 274, 313/285, 286, 253, 42, 634

[56] References Cited

U.S. PATENT DOCUMENTS

| | | | |
|---|---|---|---|
| 3,753,018 | 8/1973 | Beijer et al. | 313/25 |
| 3,882,346 | 5/1973 | McVey | 313/25 X |
| 3,992,642 | 11/1976 | McVey et al. | 313/42 X |
| 4,689,518 | 8/1987 | King | 313/25 X |
| 4,866,328 | 9/1989 | Ramaiah et al. | 313/25 |
| 4,994,707 | 2/1991 | Stark | 313/269 |

FOREIGN PATENT DOCUMENTS

| | | |
|---|---|---|
| 0508525 | 12/1954 | Canada . |
| 0085487 | 8/1983 | European Pat. Off. . |
| 0209345 | 1/1987 | European Pat. Off. . |
| 3006846 | 9/1980 | Fed. Rep. of Germany . |
| 3416714 | 11/1985 | Fed. Rep. of Germany . |
| 1583427 | 1/1981 | United Kingdom . |

*Primary Examiner*—Donald J. Yusko
*Assistant Examiner*—Ashok Patel
*Attorney, Agent, or Firm*—Frishauf, Holtz, Goodman & Woodward

[57] ABSTRACT

To reliably support a metal halide discharge vessel within an outer bulb, in spite of possible shock or vibration, and to accomodate thermal expansion in use, a support structure (6) is provided, melt-connected to the base (4) and having a cross bar portion (15) positioned transversely to the lamp axis of a length substantially less than the diameter of the outer bulb (1), and electrically and mechanically connected to one of the current supply leads (11) of the discharge vessel. The cross bar portion is connected through respectively inclined connecting portions (16, 17; 16', 17') to transversely extending first and second holding portions (20, 21; 20', 21') located within the outer bulb, and extending in chord across the outer bulb at respectively opposite sides of the discharge vessel.

20 Claims, 5 Drawing Sheets

SINGLE-BASED HIGH-PRESSURE DISCHARGE LAMP

Reference to related patent, the disclosure of which is hereby incorporated by reference: U.S. Pat. No. 4,734,612, Sasaki et al (to which European Application 0 209 345 corresponds). Reference to related publication: German 30 06 846, Kuus et al (to which Canadian 1 135 781 corresponds).

FIELD OF THE INVENTION

The present invention relates to a high-pressure discharge lamp, and more particularly to a high-pressure discharge lamp which has a double-ended discharge vessel retained within an outer envelope or bulb, in which, also, a current supply and holder frame is located so that the overall lamp structure can be single-ended or single based.

BACKGROUND

Single-based high-pressure discharge lamps usually are metal halide discharge lamps. Lamps having higher power ratings, that is, in the order of from about 500 to 2500 watts, and relatively high color temperature, are used as light sources for film and television studio illumination. The discharge vessels of these lamps require a mount or holding structure which ensures stable retention of the discharge vessel within an outer bulb. Change in position of the axial alignment of the discharge vessel, for example due to vibration, shocks and the like, must be avoided. Such lamps are frequently associated with an optical system, where the position of the light source relative to the base is important.

Lamps of this type have a serious problem since, due to the high power rating, high temperatures result. Different thermal coefficients of expansion of the various components of the lamps cause difficulties.

German Patent Disclosure Document DE-OS 30 06 846 (to which, in the English language, Canadian 1 135 781 corresponds) shows a solution to such problems. Both ends of the discharge vessel are surrounded by a guide element in form of a metal collar, which is connected to a respective part of the holder of the discharge vessel. The discharge vessel is guided in an axial position, and thermal expansion thereof is possible only in axial direction. Lateral expansion or deflection, for example by impact or vibration, is avoided.

The system requires comparatively complex manufacturing steps and is difficult to make, since the mount or support frame structure is formed of a multiplicity of parts or elements.

The high-pressure discharge lamp of the referenced U.S. Pat. No. 4,734,612, Sasaki et al (to which European Patent Publication 0 209 345 corresponds) has a somewhat simpler mount structure. A single element support frame is used, and solely retained within the pinch seal of the outer bulb. Some additional support of the mount element is given by a partial cover thereof of glass, for example a glass tube, which in part is melt-sealed within the outer bulb.

The discharge vessel holder arrangement is suitable for lamps of relatively small dimensions, and for low power lamps, for example high-pressure discharge lamps having a power rating of up to about 100 watts. High-pressure discharge lamps of higher power rating, and particularly substantially high power rating by a factor of 10 or more, cannot use this construction. The holder arrangement is not sufficiently stable for discharge vessels of the size required to operate at the substantially higher power levels.

High-pressure discharge lamps with power ratings of from 500 to 2500 watts are commercially available. These lamps have a mount or support structure which utilizes a cross element extending orthogonally to the axis of the lamp, and welded to a current supply of the distal end or remote end of the discharge vessel. The remote end of the current supply is extended beyond the weld point and supported within the outer bulb, for example at the pump or exhaust tip, or in a bulged portion within the outer bulb. High-pressure discharge lamps of particularly high power rating, in the order of from 1200 to 2500 watts may, additionally, use holder rings or tension bows, welded to the distal current supply leads and to the cross element and engaged at the inner wall of the outer bulb, for example by a clamping or resilient connection.

Lamps of this type require expensive manufacturing steps, and attachment of the additional holder rings or clamping elements increases the manufacturing costs of the mount or support structure. Lamps without suitable holder rings or clamping elements do not have sufficient resistance to vibration or shock.

THE INVENTION

It is an object to provide a single-based high-pressure discharge lamp, particularly one of high power ratings, which has a mount or support structure which can be easily and inexpensively made, while ensuring exact centering of the discharge vessel within an outer bulb, and retaining the discharge vessel securely even when the lamp is subjected to shock or vibration.

Briefly, the support structure is a unitary element extending parallel to the lamp axis towards the distal end of the discharge vessel. It includes a cross, or cross bar portion positioned transversely to the lamp axis and having a length dimension substantially less than the diameter of the outer bulb. An electrical and mechanical connection, for example a weld, is provided between the cross bar and the second current supply lead of the discharge vessel, that is, the current supply lead adjacent the distal end of the discharge vessel. First and second holding portions are located within the outer bulb at respective opposite sides of the discharge vessel and positioned essentially transversely to the cross bar portion and transversely to the lamp axis. These two holding portions are so positioned in, and have such length dimensions to, the outer bulb that they form chords within the outer bulb and define at the respective ends thereof engagement and support portions in contact with the outer bulb. The cross bar portions and the holding portions are connected together, for example by integral first and second connecting portions which extend within the outer bulb at an inclination with respect to the lamp axis. Thus, a simple mount structure is provided, which can be made as a single element, and the inclined connecting portions ensure resilient springy engagement and clamping of the support structure within the outer bulb so that changes in dimension due to thermal expansion, in operation of the lamp, of the discharge vessel can be accomodated while, additionally, damage due to shock, impact or vibration, for example during transport, will not lead to damage of the discharge vessel, and hence to the lamp as a whole.

The dimensional changes due to thermal effects, as well as tolerances, may result in changes, from a nominal dimension, of the inner diameter of the outer bulb, or in the dimensions of the support structure or mount of about 5%. This substantial difference can be readily accomodated by the inclined connecting portions, while still reliably retaining the discharge vessel within the outer bulb, and hence in a predetermined position with respect to the base connection. The thermal expansion of the mount also is compensated by the inclined connecting portions which permit some sliding of the holding portions within the lamp.

The mount structure has the other substantial advantage that the cross bar portion, to which the distal end of the double-ended discharge vessel is coupled, is symmetrically located within the lamp, with respect to the longitudinal axis of the lamp. The inclined portions then permit coupling to the holding portions which can be arranged to provide for four engagement points or lines with the outer bulb. Thus, even upon thermal expansion of the mount, the axial alignment of the discharge vessel with respect to the lamp axis is retained. The four engagement points or lines of the holding portions with the inner surface of the outer bulb are located in positions orthogonal to the longitudinal axis of the cross bar portion as well as to the longitudinal axis of the lamp. This ensures precise axial alignment of the discharge vessel and, further, improves heat conduction from the discharge vessel.

The inner surface of the outer bulb can be protected against scratching by engagement of the holding portions therewith by so forming the holding portions that all engagement points are rounded. The holding portions and, if desired, adjacent regions, and the inclined portions can be flattened, which increases the elasticity of the support structure. Otherwise, the support structure is preferably made of round wire material customary in lamps of this type.

DRAWINGS

Figure 2:
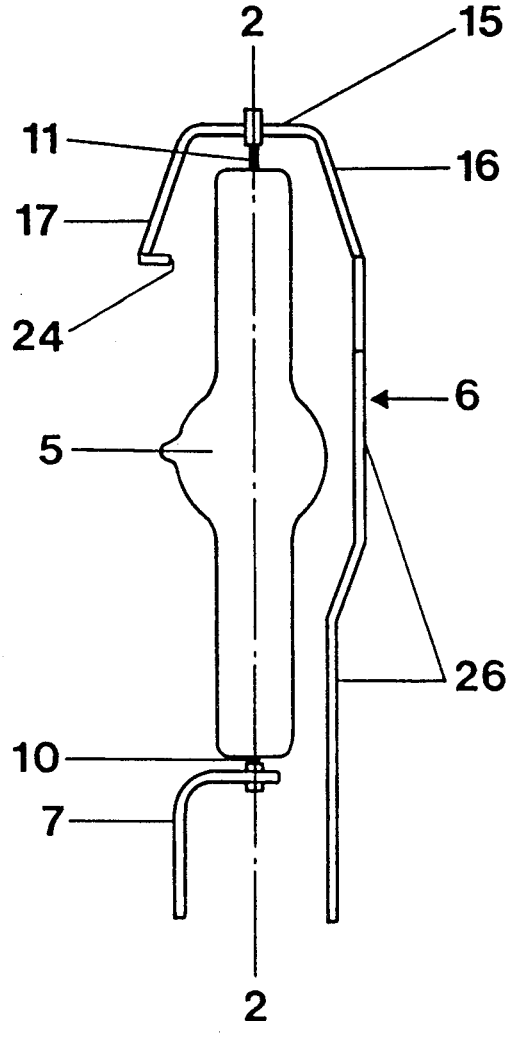
FIG. 2 is a side view of the support structure for the discharge vessel.
Figure 3A:
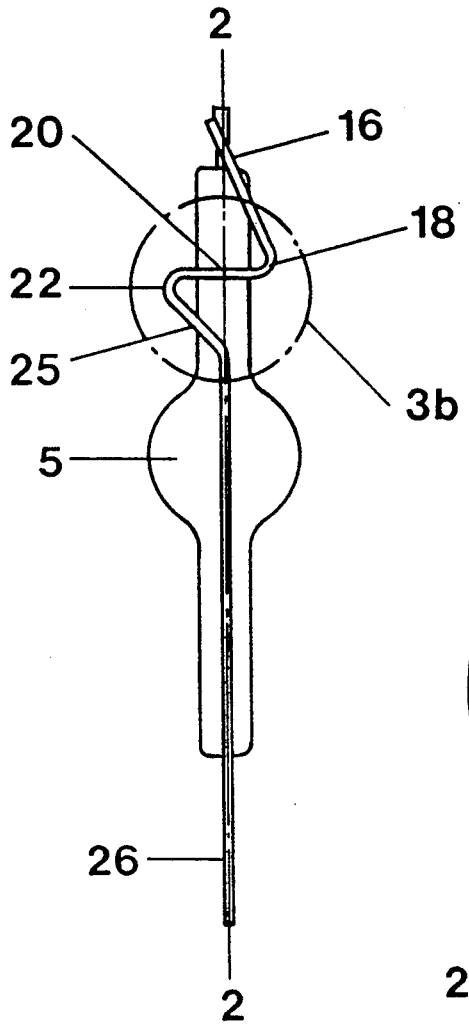
Figure 3B:
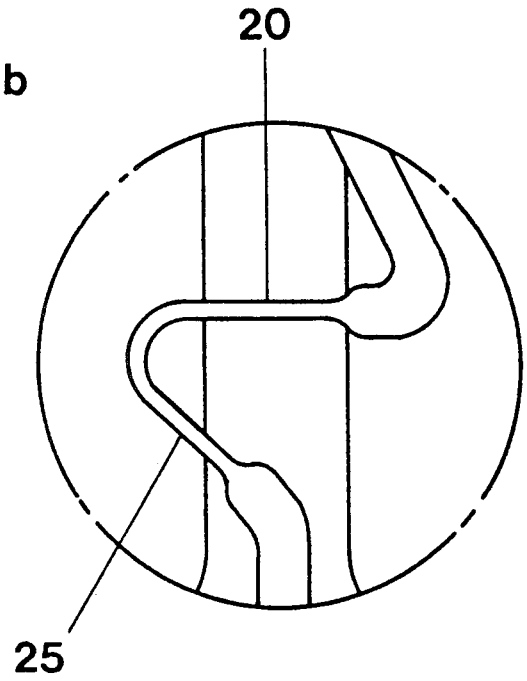

FIG. 3*a* is a side view of the discharge vessel rotated by 90° with respect to the position shown in FIG. 2;

FIG. 3*b* is a detail view of the illustration of FIG. 3*a* within the circle 3*b;*

Figure 4:
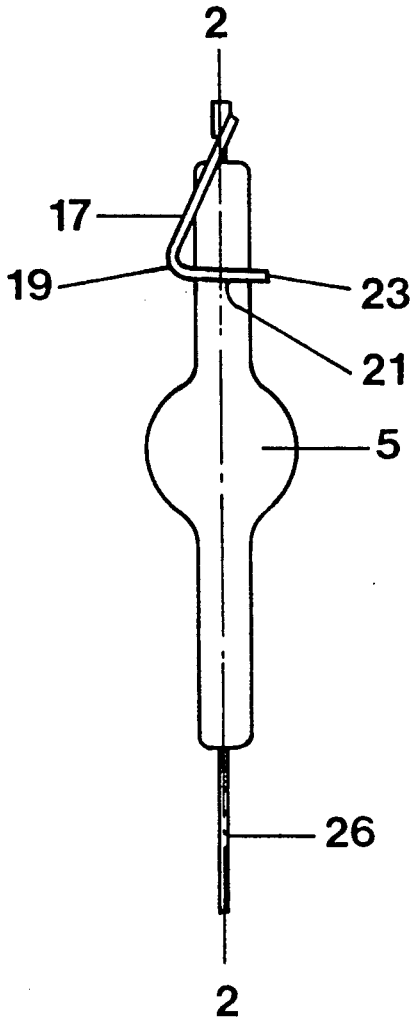
Figure 5:
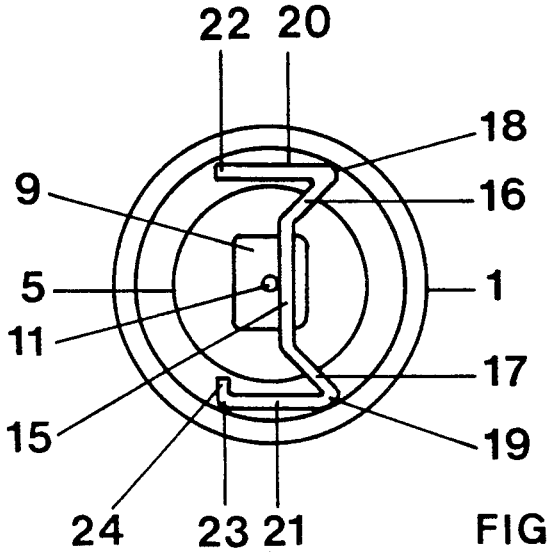
Figure 6:
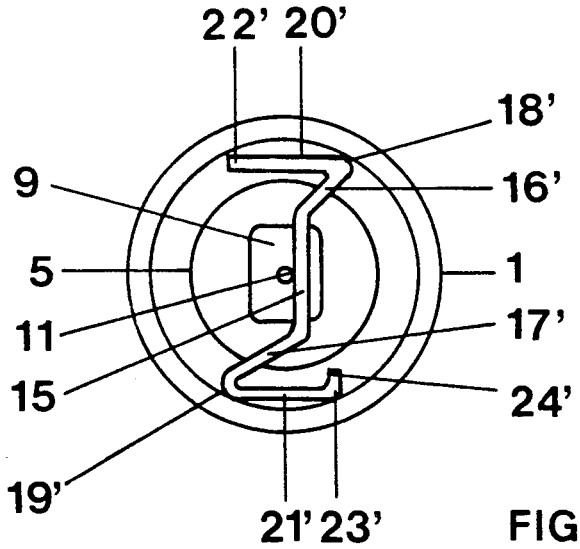
Figure 7:
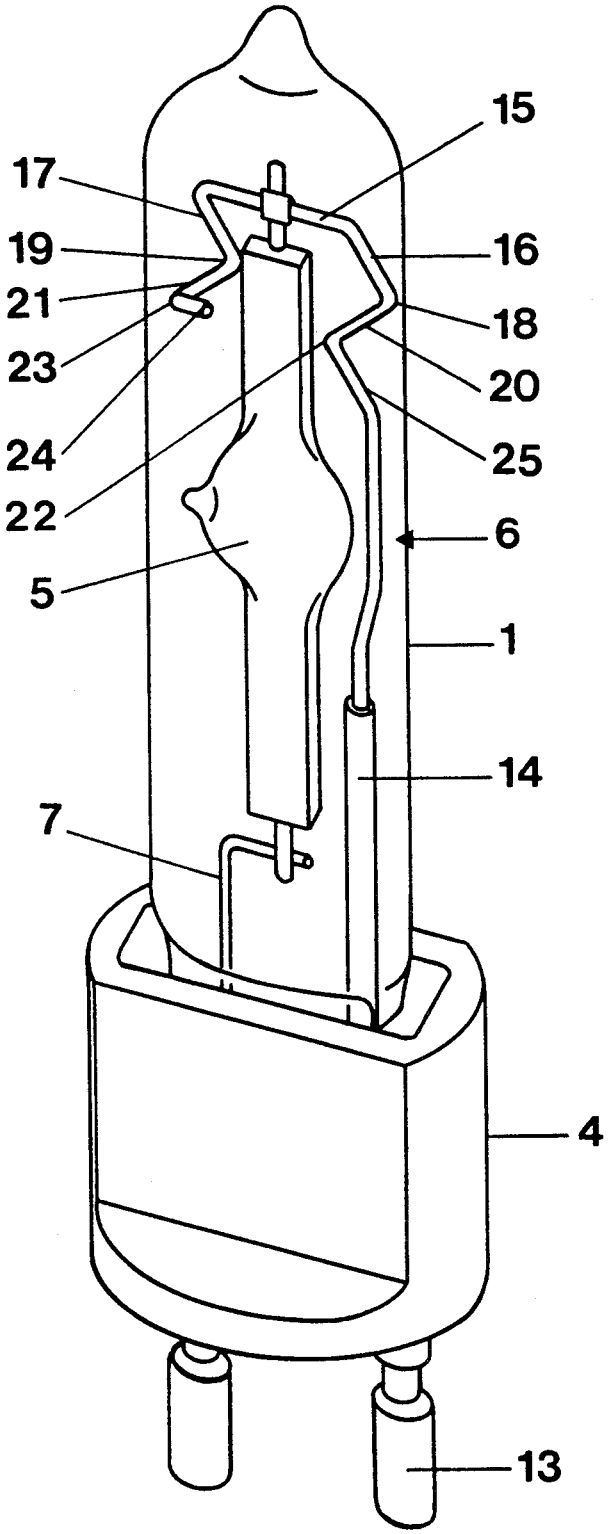

FIG. 4 is a side view of the discharge vessel with the support structure, and rotated with respect to FIG. 3*a* by 180°;

FIG. 5 is a top view of a first embodiment of the mount structure of FIGS. 1 to 4; and FIG. 6 is a top view of a second embodiment of the mount structure;

FIG. 7 is a pictorial view of the lamp with the mount structure therein.

DETAILED DESCRIPTION

Figure 1:
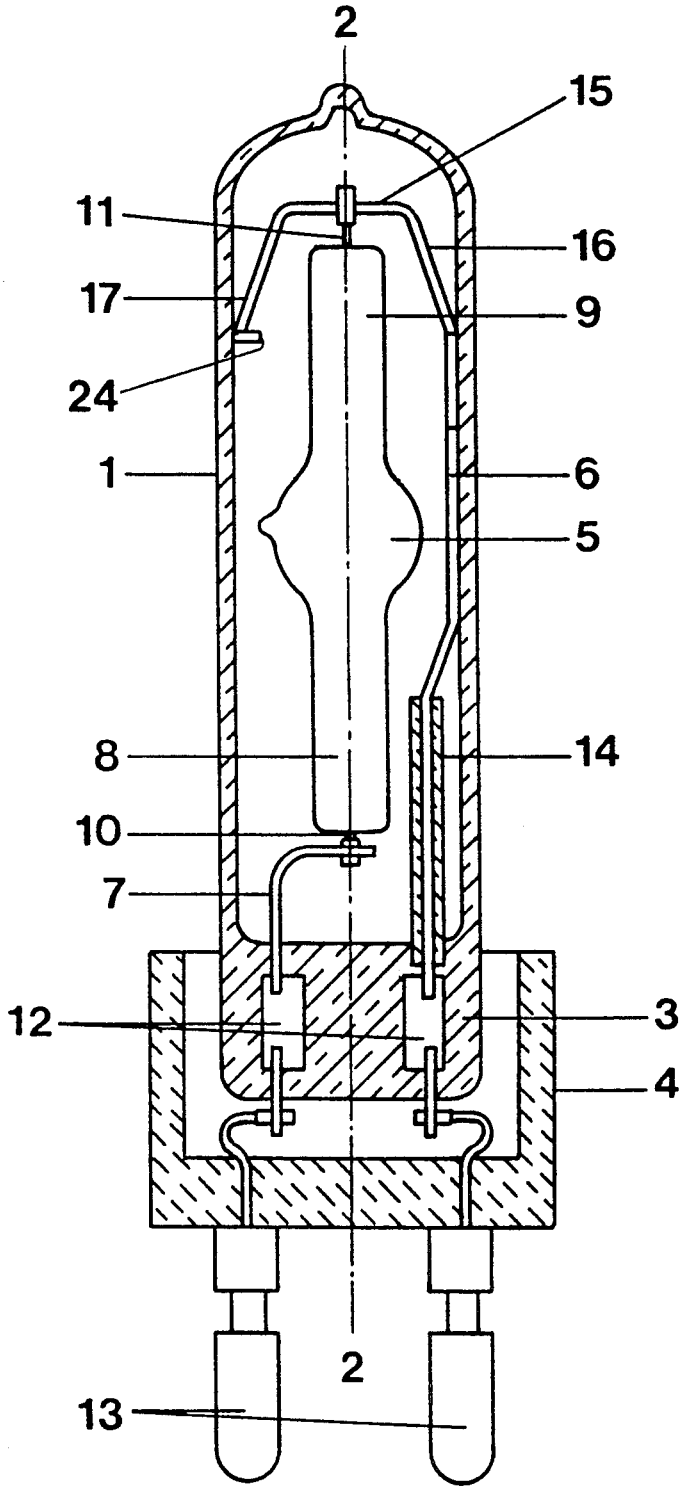
FIG. 1 is a schematic longitudinal sectional view through a single-based high-pressure discharge lamp.

Referring first to FIGS. 1 and 7:

For purposes of illustration, a 575 watt metal halide discharge lamp, with a mount structure in accordance with the present invention is shown.

The outer bulb 1 has a longitudinal axis 2. It is terminated in a pinch seal 3, and secured in a base 4 by a suitable attachment, for example cement, metal connections or the like. A discharge vessel 5 of quartz glass is symmetrically, with respect to the lamp axis 2, located within the outer bulb 1. The discharge vessel 5 is held in position by a support element 6 and a support wire 7. The support element 6 and the support wire 7, together, form a support structure or mount for the discharge vessel of the lamp. The discharge vessel 5 has a proximate end 8, that is, proximate to the base 4, and a distal, or remote, end 9, from which, respectively, proximate and distal current supply leads 10 and 11 extend. The current supply leads 10, 11 are, respectively, electrically connected to the support wire 7 and the support holder 6. Wires 7, 6 are connected to respective molybdenum foils 12 for electrical connection to terminals pins or prongs 13.

The support structure 6 is surrounded by a glass coating or glass sleeve 14 in the region of the proximate end 8 of the discharge vessel 5. The glass coating or sleeve 14 is melt-sealed in the pinch seal 3, and increases the electrical flash-over voltage.

The support structure and support element 6, in accordance with the invention, is formed with a transversely extending cross bar portion 15, as best seen in FIGS. 2–5. The cross bar portion 15 (FIG. 2) is welded to the distal current supply connection 11. The length of the cross bar portion 15 is substantially less than the inner diameter of the outer bulb 1 at the level of the cross bar portion 15. Two inclined connecting portions 16, 17 extend from the cross bar portion 15. The inclined portions 16, 17 terminate in straight holding portions 20, 21, extending in chords with respect to the outer bulb and, at the ends thereof, are formed with engagement and support points 18, 22, 19, 23, which resiliently engage the inner wall of the outer bulb 1. To prevent scratching of the outer bulb 1, all engagement points 18, 19, 22, 23 are formed as rounded corners. The free end of the support element or frame forms a small extension 24 (see FIG. 5) which is bent away from the outer wall so that no sharp ends or corners will touch the inner wall of the outer bulb 1.

A further inclined portion 25 connects the holding portion 20 to the longitudinal portion 26 of the frame 6. The connection between the further inclined portion 25 and the holding portion 20 is via a rounded bend 22 (FIG. 3*a*). The mount structure 6, which preferably is made of round wire, is flattened in the region of the support portion 20 and of the further inclined portion 25, as best seen in FIG. 3*b*, with the flattened surface extending in a plane transversely to the longitudinal axis 2 of the lamp.

The cross bar portion 15, the first and second inclined connecting portions 16, 17, as well as the first and second holding portions 20, 21, are located mirror-symmetrically with respect to a plane which is transverse to the cross bar portion 15, and which passes through the longitudinal axis 2, as best seen in FIG. 2.

The 575 W lamp, for example, has an outer bulb 1 with an inner diameter of about 24 mm. The cross bar portion 15 has a length of about 16 mm. The first and second inclined portions 16, 17 have a length of about 12 mm and the two holding portions 20, 21 have a length of about 11 mm. These dimensions are not critical, and are suitable in a lamp of the above-mentioned power rating of 575 W.

The bending direction of the first and second holding portions need not be in such a way that the arrangement is mirror-symmetrical. FIG. 6 illustrates a modification, in which the inclined portions 16',17' and the holding portions 20',21' are not mirror-symmetrical with respect to a plane, but, rather, have inversion symmetry with respect to an axis parallel to the longitudinal axis 2 of the lamp. The side views of FIGS. 1, 2, 3*a*, 3*b* would be identical for both the embodiments of FIGS. 5 and 6, and, hence, no further description is necessary, and the parts of similar elements in FIG. 6 have been given the same reference numerals. merely with prime notation, where there is a difference.

The support structure can be used with various types of high-pressure discharge lamps, and is not limited to a 575 W high-pressure discharge lamp. The outer bulb 1 need not be circular-cylindrical, but may have other forms, for example with a region of expanded diameter, for instance within the range of the bulbous portion of the discharge vessel 5. Such an expanded barrel-shaped region can readily accept the approximately spherical portion of the discharge vessel. The elongated portion 26 of the frame 6 should fit at least approximately within the inner contour of the outer bulb also in the region of such an expanded outer bulb portion.

Various changes and modifications may be made within the scope of the inventive concept.

We claim:

1. A single-based high-pressure discharge lamp having a base (4);

a transparent outer bulb (1) defining a longitudinal lamp axis (2), a proximal end (8) close to the base and a distal end (9) remote from the base;

a discharge vessel (5) located coaxially with respect to said lamp axis, and within the outer bulb;

a first current supply lead (10) extending from the proximal end (8) of the discharge vessel;

a second current supply lead (11) extending from the distal end (9) of the discharge vessel;

a lamp support means and current supply combination for the discharge vessel located within the outer bulb including a support means (7) electrically and mechanically connected to the first current supply lead (10) and melt-sealed into the outer bulb in a region of the base;

a support structure (6) electrically and mechanically connected to the second current supply lead (11) and melt-sealed into the outer bulb in the region of the base (4), and wherein the support structure (6) is a unitary element extending parallel to the lamp axis (2) towards the distal end of the discharge vessel (5) and includes a cross portion (15) positioned transversely to said lamp axis (2) and having a length dimension substantially less than an inner diameter of the outer bulb (1), and electrically and mechanically connected to the second current supply lead (11) of the discharge vessel (5);

a first (20,20') and a second (21, 21') holding portion, each located within the outer bulb at respective opposite sides of the discharge vessel (5) and positioned essentially transversely to the cross portion (15) and further transversely to the lamp axis (2), said holding portions having lengths dimensioned to form chords within the outer bulb and defining, at respective ends thereof, engagement and support points (18, 19, 22, 23; 18', 19', 22', 23') in contact and engagement with the inner surface of the outer bulb; and a first (16, 16') and a second (17, 17') connecting portion, connecting the first (20, 20') and the second (21, 21') holding portions, respectively, to the cross portion (15), said connecting portions extending toward the proximal end within the outer bulb at an inclination with respect to the lamp axis.

2. The lamp of claim 1, wherein said first and second holding portions form four engagement and support points (18, 19, 22, 23; 18', 19', 22', 23') with the outer bulb.

3. The lamp of claim 1, wherein said engagement and support points are located in a common plane extending perpendicularly to the longitudinal axis (2).

4. The lamp of claim 1, wherein said engagement and support points form rounded corners of said holding portions, and are in resilient stressed engagement with the inner surface of the outer bulb.

5. The lamp of claim 1, wherein the first holding portion (20, 20') and the first connecting portion (16, 16'), as well as the second holding portion (21, 21') and the second connecting portion (17, 17'), as well as said cross portion (15) are positioned symmetrically with respect to said lamp axis.

6. The lamp of claim 5, wherein said first and second holding portions (20, 20'; 21, 21') and said first and second connecting portions (16, 16', 17, 17') and said cross portion (15) are mirror-symmetrically located with respect to a plane through which said longitudinal axis (2) passes, and which is positioned at right angles with respect to said cross bar portion (15).

7. The lamp of claim 5, wherein the first and second holding portion (20, 20'; 21, 21') and the first and second connecting portion (16, 16', 17, 17') as well as said cross portion (15) are inversion-symmetrical with respect to an axis parallel to said longitudinal axis (2).

8. The lamp of claim 1, wherein said first and second holding portions (20, 20'; 21, 21') are straight elements.

9. The lamp of claim 1, wherein said holding portions (20, 20'; 21, 21') and said cross portion (15) are located in different planes staggered along the longitudinal axis (2);

and wherein said planes are orthogonal with respect to said longitudinal axis.

10. The lamp of claim 1, further including an inwardly projecting stub (24, 24') connected to and terminating the second holding portion (21, 21') and defining, with said holding portion, a smoothly rounded corner.

11. The lamp of claim 1, wherein said unitary support structure (6) further includes an elongated support portion (26) extending parallel to the lamp axis interiorly of the outer bulb;

an inclined coupling portion (25) extending towards an end region of said first holding portion (20, 20'), and a rounded bend connection (22, 22') between said inclined coupling portion (25) and said first holding portion (20, 20').

12. The lamp of claim 11, wherein said unitary support structure (6) comprises a rounded, in cross section circular wire element;

and wherein said wire element, in the region of the first holding portion (20, 20') and said inclined coupling portion (25) is flattened to provide for increased resiliency of said support structure.

13. The lamp of claim 12, wherein the flattened portions (20, 25) define planes which intersect said longitudinal axis.

14. The lamp of claim 1, wherein said holding portions (20, 20'; 21, 21') are located in a plane orthogonal to the lamp axis.

15. The lamp of claim 1, wherein said holding portions (20, 20'; 21, 21') are located in a plane which intersects said longitudinal axis (2).

16. A single-based high-pressure discharge lamp having a base (4);

a transparent outer bulb (1) defining a longitudinal lamp axis (2), a proximal end (8) close to the base and a distal end (9) remote from the base;

a discharge vessel (5) located coaxially with respect to said lamp axis, and within the outer bulb;

a first current supply lead (10) extending from the proximal end (8) of the discharge vessel;

a second current supply lead (11) extending from the distal end (9) of the discharge vessel;

a lamp support means and current supply combination for the discharge vessel located within the outer bulb including a support means (7) electrically and mechanically connected to the first current supply lead (10) and melt-sealed into the outer bulb in the region of the base;

a support structure (6) electrically and mechanically connected to the second current supply lead (11) and melt-sealed into the outer bulb in the region of the base (4).

and wherein the support structure (6) is a unitary element extending parallel to the lamp axis (2) towards the distal end of the discharge vessel (5) and includes a cross portion (15) positioned transversely to said lamp axis (2) and having a length dimension substantially less than the inner diameter of the outer bulb (1), and electrically and mechanically connected to the second current supply lead (11) of the discharge vessel (5);

a first holding portion (20, 20') and a second holding portion (21, 21') located within the outer bulb at respective opposite sides of the discharge vessel (5), at least one of said first and second holding portions being positioned essentially transversely to the cross portion (15) and transversely to the longitudinal lamp axis (2) and having a length dimensioned to form a chord within the outer bulb, said first and second holding portions defining, at the respective ends thereof, engagement and support points or lines of contact with the outer bulb; and a first (16, 16') and a second (17, 17') connecting portion, connecting the first (20, 20') and the second (21, 21') holding portions, respectively, to the cross portion (15), said connecting portions extending toward the proximal end within the outer bulb at an inclination with respect to the lamp axis.

17. The lamp of claim 1, wherein said discharge vessel (5) is a quartz glass vessel.

18. The lamp of claim 4, wherein said discharge vessel (5) is a quartz glass vessel.

19. The lamp of claim 16, wherein said discharge vessel (5) is a quartz glass vessel.

20. The lamp of claim 5, wherein said discharge vessel (3) is a quartz glass vessel.

* * * * *